US006386405B1

(12) United States Patent
Kars et al.

(10) Patent No.: US 6,386,405 B1
(45) Date of Patent: May 14, 2002

(54) SNAP ON CLOSURE AND METHOD

(75) Inventors: Herman P. Kars, Amstelveen (NL); Davis B. Dwinell, Carol Stream, IL (US)

(73) Assignee: Royal Packaging Industries Van Leer NV, Amstelveen (NL)

( * ) Notice: Subject to any disclaimer, the term of this patent is extended or adjusted under 35 U.S.C. 154(b) by 0 days.

(21) Appl. No.: 09/737,622

(22) Filed: Dec. 18, 2000

(51) Int. Cl.[7] ..... B65D 47/10
(52) U.S. Cl. ..... 222/541.9; 215/258
(58) Field of Search ..... 222/541.9; 215/258, 215/253, 274; 220/266, 270, 529, 541.9, 153.06

(56) References Cited

U.S. PATENT DOCUMENTS 5,641,099 A 6/1997 McLelland et al.
5,788,100 A 8/1998 Sturk
5,797,525 A 8/1998 McLelland et al.

*Primary Examiner*—Philippe Derakshani
*Assistant Examiner*—Thach H Bui

(57) ABSTRACT

A plastic pail lid opening surrounded by an upstanding closure receiving cylindrical neck is modified to incorporate a shorter outer cylindrical collar surrounding the neck. A closure assembly made up of a nestable pouring spout and an internally threaded screw cap is affixed to the opening neck. The pouring spout is surrounded by an integrally molded sealing channel having an axially extending inner wall and a peripheral interlocking outer wall. To secure the closure to the pail opening the spout inner wall is guided within the opening neck and the spout outer wall is axially forced between the outer surface of the upstanding neck and the inner diameter of the surrounding collar. With the spout sealing channel outer wall interlockingly squeezed between the opening neck and surrounding collar, a liquid tight tamper resistant connection is formed.

15 Claims, 5 Drawing Sheets

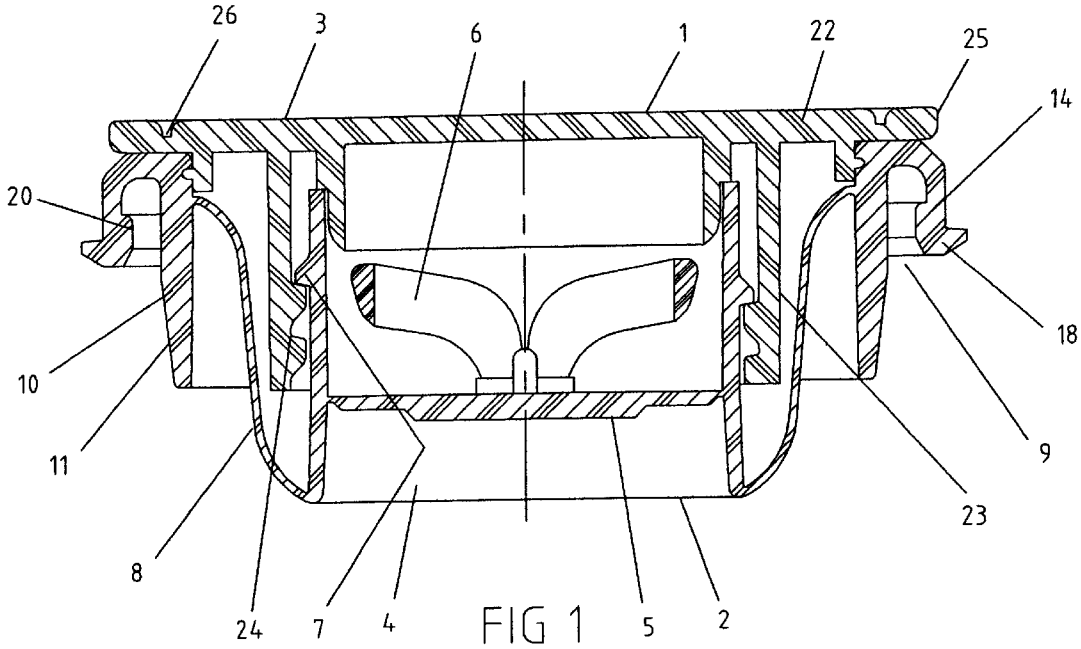
FIG 1
FIG 2
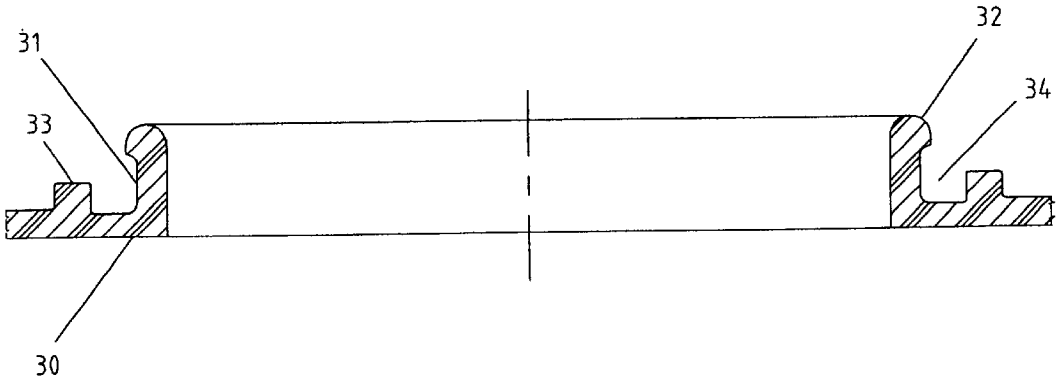

SNAP ON CLOSURE AND METHOD

This invention is directed to an all plastic dispensing closure for plastic containers and method of application.

In the field of plastic injection molded open head pails a transition is taking place toward all plastic closures. This movement is principally to accommodate environmental recycling concerns and, of course, also to effect attainable cost reductions. The market at this stage has determined that an all plastic dispensing closure can be snapped on to the upstanding opening neck of a pail lid and successfully meet the various performance criteria set by UN and DOT regulations. To date, however, those all plastic dispensing closures successfully commercialized still leave some gaps in the desirability agenda.

For example, U.S. Pat. No. 5,788,100 dated Aug. 4, 1998 discloses an all plastic snap-on closure made up of a flexible pouring spout surrounded by an annular sealing channel and fitted with an overlying screw cap. A locking ring is integrally connected about the periphery of the screw cap so as to extend radially outwardly of the spout sealing channel. In application the closure is pressed onto a circumferentially enlarged upstanding opening neck causing the sealing channel to snap thereover. During the closure application the locking ring is broken away from the cap periphery and axially pressed around the outer wall of the sealing channel so as to lock the same against the opening neck The result is a very strong closure container wall connection. The downside resides in the fact that the locking ring can be easily pried off without damage, leaving the closure exposed to undetected tampering and pilferage which negatively impacts universal acceptance.

Another example is U.S. Pat. Nos. 5,797,525 and 5,641,099 dated Aug. 25, 1998 and Jun. 24, 1997 respectively which also show an all plastic snap-on closure made up of a flexible pouring spout surrounded by an annular sealing channel and fitted with an overlying screw cap. These constructions also embody an outer locking ring integrally connected by frangible webs about the periphery of the screw cap. In application the closure is pressed onto a circumferentially enlarged upstanding opening neck causing both the sealing channel outer wall and the peripheral locking ring to snap thereover. This arrangement causes both the spout outer sealing channel and the peripheral locking ring to expand over the neck enlargement and then relies solely on the elastic memory of the plastic parts to radially contract below the neck enlargement and hold the parts tightly together. The principal problem with this construction is the inability under varied manufacturing conditions to consistently retain a tight seal due to elastic memory alone. In addition undetected tampering can also be readily accomplished by simply prying the fitting off of the opening neck

SUMMARY OF INVENTION

The invention closure and method overcomes these prior art deficiencies in a very simple and straight forward manner. As explained above, the current prior art practice is to one way or another, during application, surround the fully seated sealing channel outer wall with a locking ring introduced as an integral part of the closure. In accordance with the invention the locking ring is instead integrally molded in the pail lid as a raised annular collar spaced from and surrounding the upstanding opening neck The outer wall of the spout sealing channel is, during application, then squeezed into the annular gap formed between the neck and the collar creating a very strong, liquid tight engagement between the closure and the pail lid. The advantages of the invention closure and method are immediately apparent There is no breaking away of relatively fragile parts which are then stretched around other parts. There is no reliance on elastic memory for holding parts together. Most importantly, the tamper resistance of the invention closure is substantially increased, as there is no readily undetectable way the fitting or any part thereof can be pried off the pail lid. This characteristic in itself clearly distinguishes the invention closure over other snap-on all plastic closures currently in use. Moreover the ultimate simplicity of application to the pail lid easily constitutes a further advance in the art.

It is accordingly a principal object of the invention to provide a new and improved all plastic closure for containers and method of application.

Another object is to provide an all plastic dispensing closure, which is interlocked with a unique lid opening configuration.

A further object is to provide a new pouring spout closure that permanently engages the pail lid opening with superior tamper resistance.

Other and more detailed objects of the invention will in part be obvious and a part pointed out as the description taken in conjunction with the accompanying drawing proceeds.

In that drawing:

FIG. 1 is a vertical sectional view of a closure prior to application to a container neck in accordance with the method of the invention;

FIG. 2 is a vertical sectional view of a container neck of the invention for receiving a dispensing closure;

DETAILED DESCRIPTION OF THE INVENTION

Figure 3:
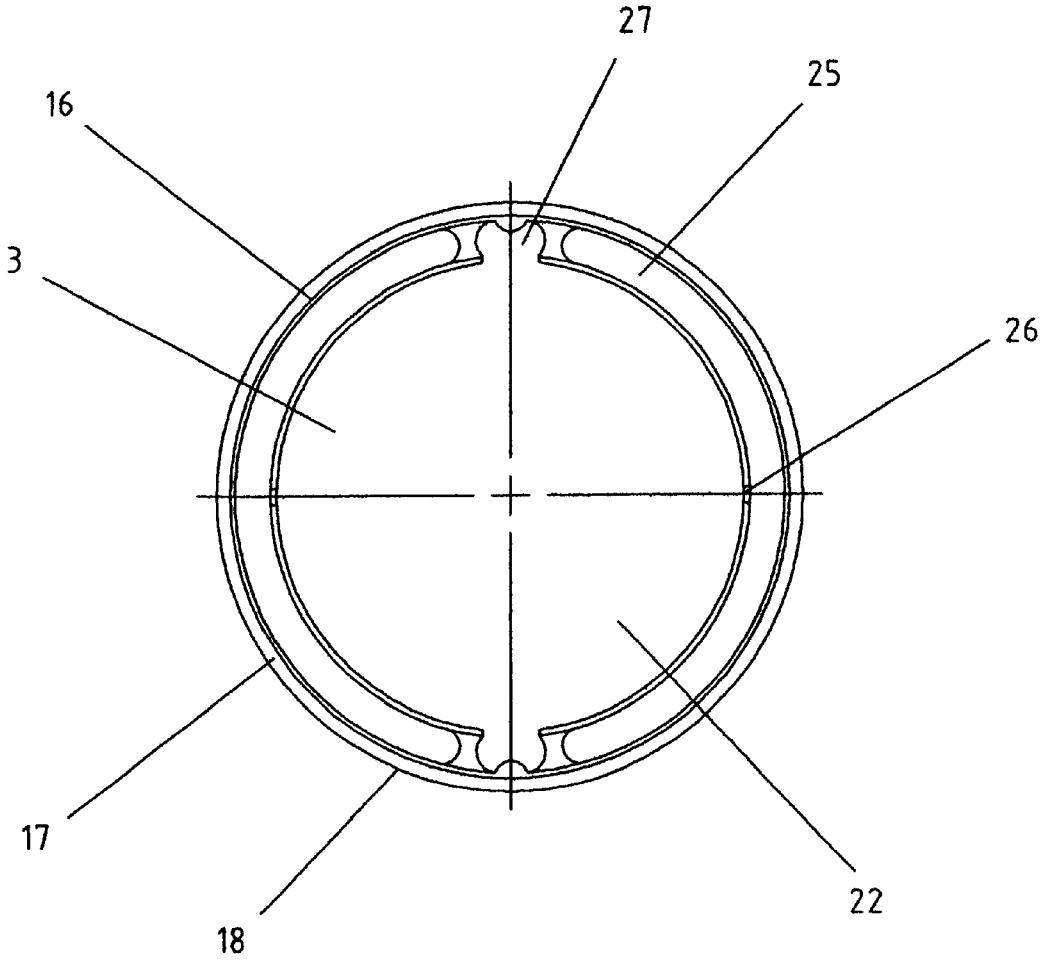
FIG. 3 is a top plan view of the invention closure.

The container closure assembly generally indicated at numeral 1 in FIG. 1 is seen to consist of a nestable pouring spout 2 molded of low density polyethylene and an overlying screw cap 3 molded of high density polyethylene or similar plastic. The spout is formed with an axially extending dispensing neck 4 closed off by a tear out membrane 5 having a ring pull 6. The upper portion of the neck 4 has an external thread 7 and the lower end of the neck is integrally connected to flexible wall 8 in turn joined at its uppermost end to circumferential sealing channel 9. The sealing channel 9, as clearly seen in FIG. 4, has an axially elongated inner cylindrical wall 10 which extends beyond the vertical midpoint of flexible wall 8 and has a downwardly and inwardly extending conical surface 11 further provided with one or more vertical drainage slots 12. At the upper end portion of inner channel wall 10 above the juncture of spout flexible wall 8 there is an annular undercut retaining groove 13. The sealing channel 9 is further provided with an outer wall 14 having an exterior upward and radially outwardly facing camming surface 15 at its upper end. Camming surface 15 joins a cylindrical outer surface 16 which terminates in a annular upwardly facing load bearing surface or shelf 17 on circumferential presser foot 18. The bottom of presser foot 18 has a downwardly and radially outwardly facing camming surface 19. The inner surface of outer sealing channel wall 14 has an internal bead 20 partially closing off the mouth of the sealing channel and terminating at its lowermost end in radially inwardly and downwardly facing camming surface 21.

The screw cap 3 has a disc like top wall 22 with a central cylindrical sidewall 23 depending therefrom having an internal thread 24 for engagement with the spout thread 7. A pair of lifting bails 25 surround the cap top wall 22 and are connected by a series of frangible webs 26 and diametrically opposed hinge points 27. The screw cap 3 is further provided with a short skirt 28 depending from the periphery of top wall 22. An annular locking rib 29 surrounds the lower skirt portion and engages within the spout groove 13 with the cap in assembled position.

As seen in FIG. 2 a container wall or in this case a pail lid 30 is shown having an upstanding neck 31 surrounding the standard dispensing opening and terminating in a circumferentially enlarged retaining lip 32. A locking collar 33 is concentrically disposed radially outwardly spaced from neck 31 creating an open annular groove 34.

Figure 4:
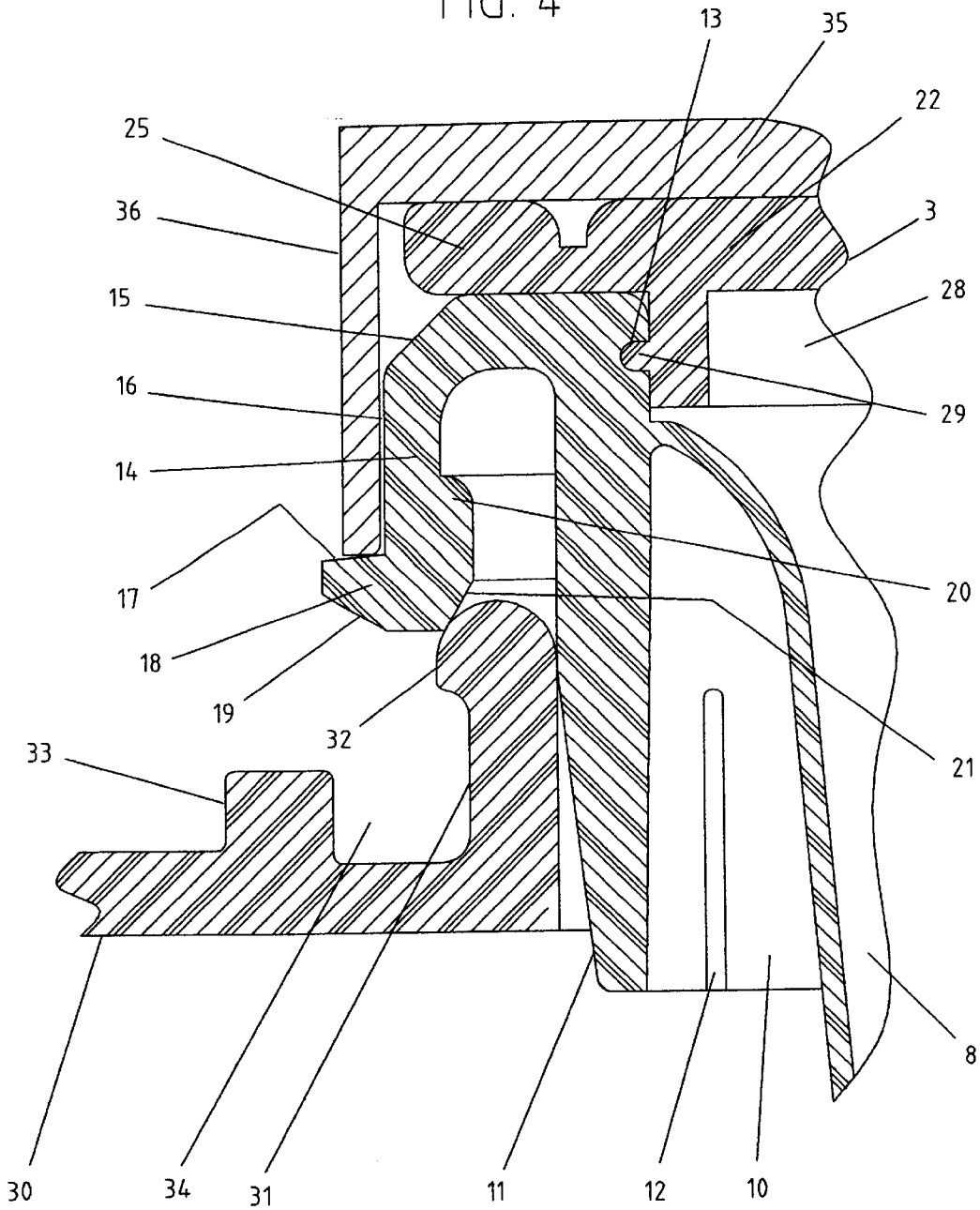
FIG. 4 is a partial vertical sectional view showing the closure initially positioned on the opening neck.
Figure 5:
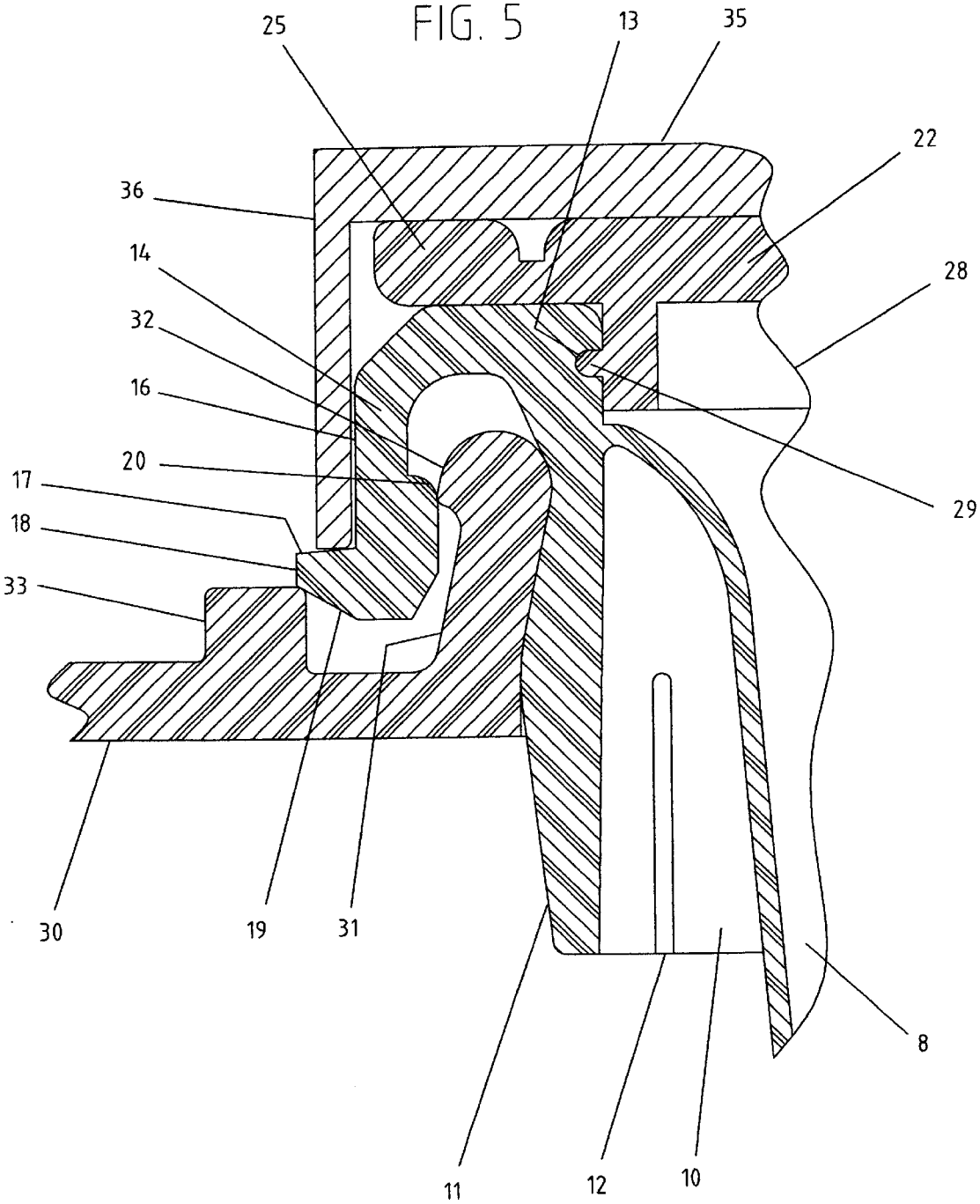
FIG. 5 is a view similar to FIG. 4 and showing the closure in an intermediate position during application.
Figure 6:
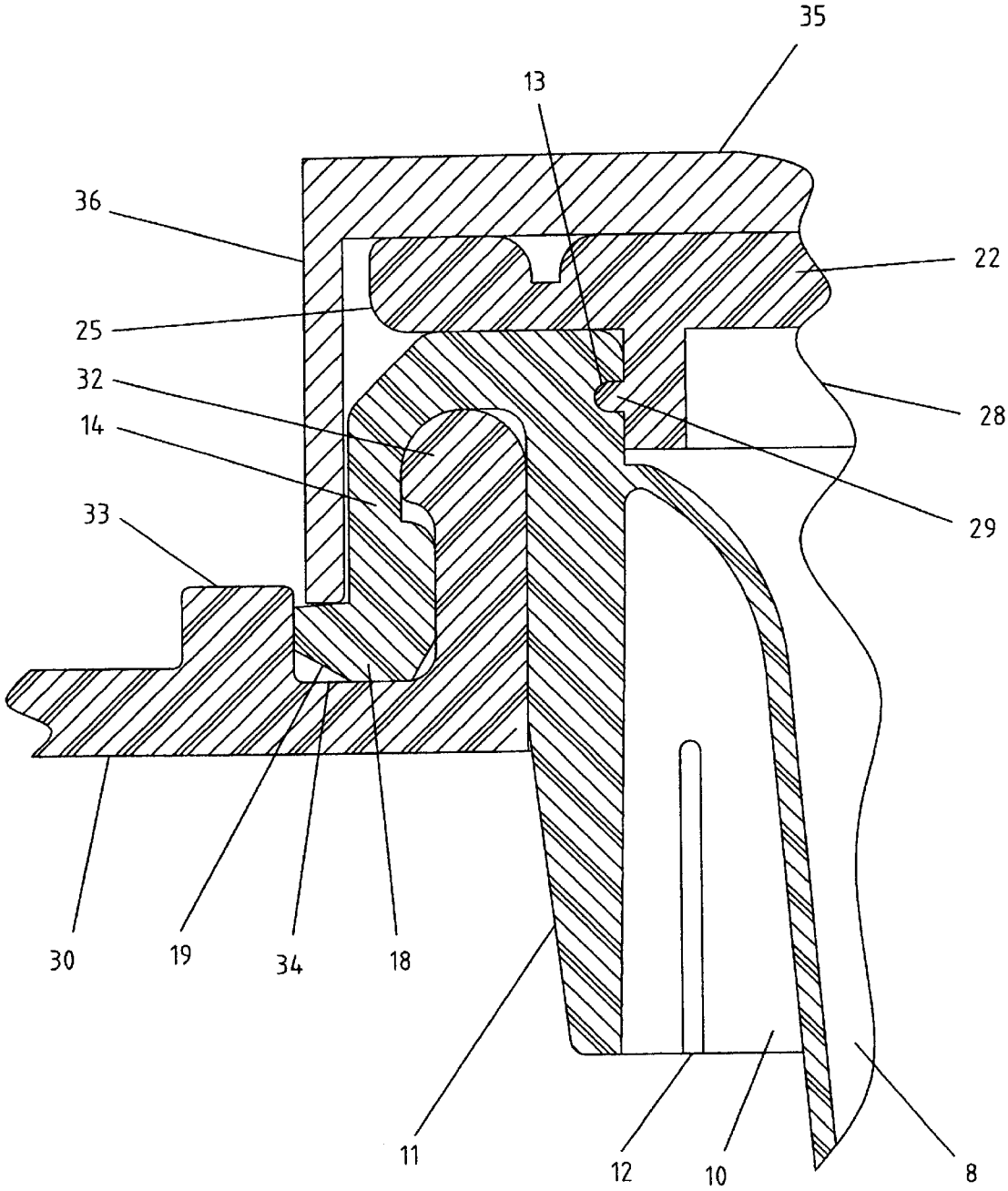
FIG. 6 is another view similar to FIG. 4 showing the closure in fully seated and interlocked final position.

Turning to the insertion process as initially viewed in FIG. 4, the closure 1 is placed on the opening neck 32 with the inner sealing channel wall 10 entering the lid opening and the conical wall surface 11 acting as a guide. In this position the sealing channel outer wall camming surface 21 rests on the opening neck lip 32. A axially driven insertion tool 35 having an outer cylindrical wall 36 is placed over the closure with the camming surface 15 acting as a guide so that the lower end of the wall 36 comes in contact with the presser foot bearing surface 17 as the tool body bears against the cap top wall 22. Continued vertical displacement of the tool 35 against the supported container wall 30 causes the camming surface 21 on bead 20, due to the pressure of the insertion tool outer wall 36 against the cylindrical surface 16, to squeeze the opening neck-and inner sealing channel wall radially inwardly a small amount as shown in FIG. 5. At this point the presser foot camming surface 19 is brought into engagement with the inner top corner of the locking collar 33. As shown in FIG. 6 the final small amount of vertical displacement bumps the presser foot inside the collar 30 so that the bottom surface of the outer channel wall 14 rests against the bottom of groove 34. In this position it can be seen that the internal bead 20 has moved past the neck lip 32 and become locked securely thereunder. The insertion tool 35 is then retracted leaving the closure tightly and permanently applied to the container opening.

From the forgoing the numerous advantages of the invention are readily apparent. First and foremost, the invention closure is substantially more tamper resistant than other all plastic closure constructions. Vertical retraction of the pressure foot 18 from the groove 34 is prevented by the interlocking undercuts between the opening neck and the outer channel wall. Prying the presser foot out of the groove 34 is a virtual impossibility without clear indication of tampering. The high radial compression created between the collar 30 and the inner channel wall 10 assures a liquid seal under the most rigorous conditions. In addition the radial contraction of the spout inner wall serves to effectively tighten the engagement with the cap skirt 28 so that inadvertent dislodgment of the locking of the locking rib 29 with the groove 13 becomes unlikely due to unavoidable upward force or pressure on the bottom of the nested spout. A further advantage in the invention construction is the ability to also apply, if need be, a conventional crimped on closure to the opening neck configuration. This flexibility has significant commercial ramifications.

Various other changes in or modifications to the closure and insertion method of the invention would suggest themselves to those skilled in the art and could be made without departing from the spirited and scope of the invention. For example, different types of plastic resin could be employed to mold the various elements. It is accordingly intended that all matter contained in the above description or shown in the accompanying drawing shall be interpreted as being illustrative and not in a limiting sense.

We claim:

1. In combination, a pail lid having a closure receiving opening therein, said opening surrounded by an upstanding neck terminating in a circumferentially enlarged retaining lip, a dispensing closure seated on said upstanding neck, said dispensing closure having an integrally connected outer wall surrounding said upstanding neck in sealing engagement therewith and means integrally formed on said pail lid tightly surrounding said outer wall whereby undetected axial displacement of said closure relative to said pail lid is prevented.

2. A combination as in claim 1, said means integrally formed on said pail lid comprising an upstanding annular collar radially outwardly spaced from said upstanding neck.

3. A combination as in claim 1 and said dispensing closure having an integrally connected inner wall extending tightly within said upstanding neck.

4. In combination a container lid having a closure receiving opening therein, said opening surrounded by an upstanding neck terminating in a circumferentially enlarged retaining lip, an annular upstanding locking collar surrounding said neck radially spaced therefrom, a dispensing closure seated on said upstanding neck having a circumferential sealing channel, said channel having a substantially cylindrical inner wall extending within said neck, a top wall bearing against said retaining lip and an outer wall radially compressed between said locking collar and said upstanding neck.

5. The combination of claim 4 and said dispensing closure including a nestable pouring spout.

6. The combination of claim 5 and said dispensing closure including a screw cap threadedly engaged on said pouring spout.

7. An all plastic dispensing closure comprising a pouring opening, a closure member engaging said opening, an annular sealing channel surrounding said opening, said channel having a substantially cylindrical inner wall, an annular top wall and a circumferential outer wall, said outer wall having a lower radially inwardly formed sealing bead terminating in a lower extremity, an inner cam surface at said sealing bead lower extremity, an outer cam surface at the outer wall lower extremity and a load bearing shelf surrounding said sealing channel.

8. An all plastic dispensing closure as in claim 7 and interlocking means directly interposed said inner wall and said closure member.

9. An all plastic dispensing closure as in claim 8 wherein said interlocking means forms a seal between said inner wall and said closure member.

10. An all plastic dispensing closure as in claim 7 wherein said shelf is disposed directly above said outer cam surface.

11. An all plastic dispensing closure adapted for sealing engagement to an upstanding container opening neck terminating in a circumferential enlarged retaining lip having a first outside diameter, an upstanding collar surrounding the lower portion of said neck and radially spaced therefrom having a second inside diameter, said closure comprising a dispensing opening surrounded by a circumferential outer wall, said outer wall having an internal diameter less than said first outside diameter and an outside diameter at least as great as said second inside diameter.

12. An all plastic dispensing closure as in claim 11 and said outside diameter of said outer wall being greater than said second inside diameter of said collar.

13. An all plastic dispensing closure as in claim 11 and said outer wall being substantially equal in length to said container opening neck.

14. An all plastic dispensing closure as in claim 11 wherein said outer wall has a radial width in vertical cross section greater than the neck and collar radial spacing.

15. The method of affixing a dispensing closure to a container lid opening surrounded by an upstanding neck and having an upstanding collar surrounding said neck radially spaced therefrom, said closure having an annular sealing channel with inner and outer walls comprising the steps of:

a) seating said closure on said neck with said closure inner wall extending within said opening, b) axially displacing said sealing channel over said neck, c) surrounding said neck with said sealing channel outer wall, d) forcing said outer wall within said upstanding collar and exerting a radial compressive force between said sealing channel outer wall and said upstanding neck.

* * * * *